United States Patent [19]

Nowak et al.

[11] 4,204,836

[45] May 27, 1980

[54] CYCLONE FURNACE FOR INTENSIVE TREATMENT OR COMBUSTION OF DISPERGATED MINERAL RAW MATERIALS

[75] Inventors: Edmund Nowak, Kraków; Rudolf Żamojdo, Wrocław; Andrzej Parda; Wiesław Kurdowski, both of Kraków; Stefan Jankowski, Wrocław, all of Poland

[73] Assignee: Instytut Przemyslu Maszyn Wiazacych Materialow Budowlanych, Opole, Poland

[21] Appl. No.: 948,995

[22] Filed: Oct. 5, 1978

[51] Int. Cl.[2] ..... F27B 15/00

[52] U.S. Cl. ..... 432/58; 34/57 E; 110/244; 110/264

[58] Field of Search ..... 432/58, 15; 34/57 E; 110/243, 244, 245, 264

[56] References Cited

U.S. PATENT DOCUMENTS

| | | | |
|---|---|---|---|
| 3,759,501 | 9/1973 | Foard | 266/10 |
| 3,773,892 | 11/1973 | Reimann et al. | 432/15 |
| 3,834,860 | 9/1974 | Fukuda et al. | 34/57 E |

*Primary Examiner*—John J. Camby

*Attorney, Agent, or Firm*—Haseltine, Lake & Waters

[57] ABSTRACT

A furnace is provided with a separate cyclone chamber for combusting the fuel, provided with a double-sided outlet for heating gases. The heat release of this chamber having relatively small overall dimensions can reach the order of $40 \cdot 10^6$ kcal/m$^3$.h. The outlets of the heating gases are on both opposite sides of the chamber are connected with cyclone reaction chambers where the processing of the mineral raw material occurs at temperatures established by the technology in the range up to 2500° C. The furnace products flow down into a lower precipitation chamber where the non-gaseous content is finally separated from the gaseous components of the product.

Depending on the process parameters and the type of the mineral raw material, the furnace product can be molten or sintered, or have a gaseous form. The waste heat of exhaust gases and heat originated by cooling of the furnace is utilized in utilizing arrangements. The furnace can be employed in processes relating to building material industry, chemical industry and in non-ferrous and ferrous metallurgy.

6 Claims, 4 Drawing Figures

III—III

CYCLONE FURNACE FOR INTENSIVE TREATMENT OR COMBUSTION OF DISPERGATED MINERAL RAW MATERIALS

BACKGROUND OF THE INVENTION

This invention relates to a cyclone furnace for intensive treatment or combustion of finely ground mineral raw materials in dispergated state. The furnace according to the invention can be employed for processes in the building material industry, chemical industry or in the non-ferrous and inferrous metallurgy.

The up-to-date development of industrial applications of the methods of intensive conducting of flame processes with utilization of cyclone chambers has brought the formation of two basic groups of installations directed to intensive thermal processing of dispergated raw materials.

The first group constitute the so called cyclone melting chambers; the second group are called cyclone flame reactors.

The cyclone melting chamber consists of a vertical, mostly cylindrical cyclone chamber whereto jointly or through separate channels the fuel, the oxygen carrier, and the mineral raw material to be processed are supplied. The chamber forms an exclusive and in the technical sense a complete processing installation aimed at complete melting of the processed raw material, and of ash in case of combustion of ash-containing fuel.

In the cyclone melting chamber, as a result of tangential introduction of fuel and oxygen carrier a swirled stream of combustion products is generated. The dispergated raw material supplied into the same chamber and present therein is entrained by the stream, and enables it to maintain or in case of non-tangential supplying, also to assume a vortex motion. The result of the vortex motion and of polydispersion of the processed raw material is a segregation of its particles. The more coarse particles depositing on the cylindrical chamber wall are subjected to melting, and form a flowing down layer of the fusion, the remaining more fine particles, not having sufficient time to reach the wall of the chamber, are melted within the chamber space, and are discharged therefrom in the stream of exhaust gases. The fusion flowing down over the cylindrical chamber wall and the gaseous combustion products of the fuel, carrying the more fine non-separated particles of the fusion, leave the cyclone melting chamber through one common port arranged in the bottom of the chamber. The non-separated portion of the fusion, escaping with the exhaust gases to outside the room of the processing installation, gets partially deposited on the walls of precipitation chamber.

The cyclone flame reactors representing the second group of installations for thermal processing of raw materials, have the structure of an horizontally or vertically arranged cyclone chamber provided with a jet burner of complete combustion fitted tangentially to the chamber cover. The chamber is in its cylindrical wall provided with a connection with the raw material supply system. The jet burner connected with the supply system of fuel and of oxygen carrier, supplies the cyclone chamber with a stream of combustion gases by means of the heat where the processing of the raw material is realized.

A development of the construction of cyclone flame reactors consists therein that between the jet burner and the cyclone chamber a so-called mixing chamber is provided wherein the raw material is introduced. In the mixing chamber, the raw material is mixed with the stream of gases flowing out of the jet burner, and being carried by the stream it gets heated up, and together with the stream of gas enters through a tangential inlet into the cyclone chamber where it gets melted. The mechanism of course of the melting process of the raw material within the cyclone chamber of the cyclone flame reactor is analogical to that occurring in a cyclone melting chamber. The fusion depositing on the walls of a cyclone chamber being positioned for instance horizontally flows out through a special port made in the bottom of the chamber near to its contact edge with the cylindrical wall. The exhaust gases, however, flow out together with the particles of non-separated fusion through a port arranged centrically in the bottom of the cyclone chamber. In case of vertical position of the cyclone chamber, the fusion and gases are disposed through a common outlet also arranged in the bottom of the chamber.

From among the publications showing the above specified solutions as known the following can be mentioned:

J. A. Niefiedov et al.: Ciklonnaja plavka v cziernoj mietallurgii. Kiev, Tiechnika 1975; E. S. Frantov: Primienienie ciklonnogo principa w ogniewych tiechnologiczeskich processach. in: Wysokoforsirowannyje ogniewyje processy. Collective work under the redaction of M. A. Nadjarov. Moscow-Leningrad: Energia 1967 p. 164–177. Author's certificates of USSR No. 535448, F27B 15/00; No. 531008, F27B 15/02; No. 366330, F27B 15/00; U.S. Pat. No. 3,759,501, F27B 15/00 (Cyclonic smelting apparatus).

The disadvantages of known apparatus for intensive thermal treatment of raw materials are discussed hereinbelow.

In case of a cyclone melting chamber, a substantial disadvantage is that the process of combusting the fuel and the treating process of melting the raw material are conducted within the same space. In the common space, a mutual disturbance of the fuel combusting process and the raw material treating process occurs since the courses of both processes are ruled by essentially different principal laws. The cyclone melting chamber being sometimes similar to the cyclone fuel combustion chambers, especially to those employed in thermal power stations, concurrently with the increase of its overall dimensions becomes less and less effective in removal of detrimental effects of the mutual interferences of processes, making it possible to control the continuity of the process in course of operation of the installation, as well as achieving of other advantages both technical and economical. The disadvantages do not occur only in units having small overall dimensions, and thus showing a low output. The occurrence of mutual interferences of processes running within a cyclone melting chamber causes the process to operate at temperatures not exceeding 1600° C., and that as a rule the capacity of melting chambers cannot exceed 5 t/h. Such low capacity does not fulfill the requirements of the industry. The calorific effect of combustion of liquid and gaseous fuels in cyclone melting chambers, due to interference of the combustion process and the treatment process is within the limits of $8–12 \cdot 10^6$ kcal/m$^3$.h. The industry, instead, looks for thermal units showing the combusting calorific effect of the order of $20–30 \cdot 10^6$ kcal/m$^3$.h. Certain treating processes requiring high temperatures, of 2000°

C. or more, can be realized advantageously only when the fuel is combusted with a calorific effect of 35–40·$10^6$ kcal/$m^3$.h.

On the other hand, the cyclone flame reactors eliminate the most significant disadvantage of cyclone melting chambers by employing of an outer jet burner, and contingently of a mixing chamber, but this aim is achieved by deflecting from the principle and from profitable effects of fuel consumption in the cyclone chamber. The most important feature of the cyclone process in the cyclone chamber is the ability to mix or to separate the substances in the process with high capacity, and the ability of to achieve high values of the coefficient of heat and mass exchange. Thus in this aspect, the cyclone flame reactors are even inferior to the cyclone melting chambers if they are featured with low capacities. The purposefulness of maintaining reasonable dimensional proportions of the jet burner and the mixing chamber and cyclone chamber causes that the heat released of the last usually not to exceed the value of 6·$10^6$ kcal/$m^3$.h. As a consequence thereof, as for cyclonic process, a low unitary capacity of the cyclone flame reactor results which for low-melting raw materials, is melting at the temperature up to 1300° C., does not exceed 0.4 t/$m^3$.h.

Another inconvenience of known installations for thermal processing of raw materials is the impossibility of using coal as a fuel. The ashes remaining after combustion thereof enter into the composition of the alloy produced in the treatment process. The cyclone reactor provided with a jet burner and being coal-fired in a particular way manifests the natural trend of coal to burn with a long flame, with low heat releases of the combustion chamber, not exceeding the value of 2·$10^6$ kcal/$m^3$.h. This phenomenon constitutes an insurmountable difficulty of correlating the coal jet burner with the cyclone chamber of the reactor. Finally, a common inconvenience both for cyclone melting chambers and the cyclone flame reactor is the low efficiency of separation of the fusion from the stream of gases leaving the cyclone chamber. Not more than 60% of the alloy produced in the cyclone chamber flows off into the processing apparatus. The remaining portion, however, being not the separated fusion, escapes from the chamber together with the exhaust gases. A cause of essential difficulties of to separate off this portion of the fusion from the gases beyond the space of the processing apparatus is the high dispersion ability. Also as a result of lower temperatures occurring therein, the fusion increases its viscosity and/or solidifies mostly on the walls of the precipitation chambers or discharge ducts forming difficult to remove accretions. The solidified fusion is as a rule not appropriate for processing with the fusion flowing out of the cyclone chamber, but requires another mode of utilizing or to return it to repeated melting. The removing of accretions and/or the recovery of fusion carried by the gases makes necessary to heat up the walls of the precipitation chambers by means of additional burners at temperatures higher than that of solidifying the fusion. This operation is accompanied by a considerable increase of the unitary heat consumption.

Finally, it should be mentioned that known installations for thermal treatment of mineral raw materials have a closely restricted application range, as they are employed only for melting raw materials. The combustion or sintering of mineral raw materials is not conducted in known melting installations.

The present invention is aimed at elimination of the disadvantages shown by the above presented cyclone apparatus, and thus providing uniform construction of the furnace with respect to the conditions of conducting the treatment process and the possibility of to employ the furnace in several branches industry as a universal design. In the design according to the invention, a separate cyclone chamber of fuel combustion is employed, provided with two-sided outlet of heating gases. The chamber operates essentially in an horizontal arrangement, whereby the profiled outlets for heating gases produced therein are made in non-cylindrical side walls of the chamber. The cyclone combustion chamber is provided with a system supplying energy-formative agents, situated in the middle of the entire length of the cylindrical wall of said chamber. The system comprises the duct of the oxygen carrier, arranged tangentially to the cylindrical wall of the chamber, further, in close vicinity of the duct, a device, preferably in form of a slot-type burner, introduces the fuel mix into the chamber, and a device for the burning, usually of a type of portable burner. The inlet of the device is arranged near to the periphery of the combustion chamber, parallel to the duct of the oxygen carrier. When using coal as fuel, and if the ash generated therefrom must not enter into the composition of the furnace product, the combustion chamber is additionally equipped with stub connections for discharging the molten ash outside. The stub connections for discharging the molten ash are located in the lower portion of the cylindrical wall of the combustion chamber in vicinity of the periphery of opposite non-cylindrical walls. The profiled outlets in the opposite non-cylindrical walls of the cyclone combustion chamber lead to cyclone reaction chambers wherein the mineral raw material on being mixed with heating gases is subject to proper thermal treatment. Each cyclone reaction chamber is in its upper part, in the centre of the cover, provided with the supply system for mineral raw material, and provided at the end with a concentric compression chamber connected with a compressed air source. The compression chamber operating according to the principle of injection, secures a steady down-directed flow of the raw material inside the cyclone reaction chamber. The vertical axis of the cyclone combustion chamber is displaced in relation to the vertical axis of the cyclone reaction chambers in such way that the heating gas streams flow from the combustion chamber almost tangentially to the walls of the reaction chambers and therein assume a vortex motion. The displacement of axes equals to 1/6 through 3/6 of the diameter of combustion chamber.

The cyclone reaction chambers in their narrowing lower part terminate with outflow openings simultaneously forming a connection with the precipitation chamber. The precipitation chamber forms an element closing the furnace structure from the bottom. The chamber is made in the form of a closed tank where through an extreme outflow opening in the roof the furnace product flows down from the cyclone reaction chambers. The outlet of the duct of exhaust gases is arranged between the outlet holes, in the middle of their distance. The gases are eventually separated from the non-gaseous particles of the furnace product. A symmetrical arrangement of the outlet holes in the roof in relation to the outlet of the duct of exhaust gases, improves the hydrodynamical characteristic of the precipitation chamber and unifies the conditions of separation of the fusion particles from streams flowing out of the reaction chambers. In order to discharge the non-gaseous portion of the furnace product, the precipitation chamber is in its bottom part provided with a drain. The axes of the duct of exhaust gases are situated in one common plane. Such an arrangement of the outlets advantageously influes the operation of the precipitation chamber because it allows utilization of the dynamic pressure of the gases flowing out of reaction chambers onto the bottom of the precipitation chamber to assist the outflow (gravitational) by the nature of the non-gaseous product from the furnace. Moreover, the drain has a decompressive connection with the duct of exhaust gases, in order to eliminate the effects of excessive dynamic pressure, manifesting itself in knocking out of a portion of gases.

If the final product is a fusion then the drain is connected with a fusion processing apparatus. In the case, however, of a sintered product, the precipitation chamber is over the drain connected with a duct collecting plant.

The walls of the furnace chambers, exposed from their inner sides to direct action of high temperatures and corrosive agents, are lined with a thin layer, not less than 12 mm thick, of mineral refractory fastened on known metal pins. The basic criterion of selection of the refractory is the linear thermal conductivity. Outside, however, the chambers are fitted with an hermetic casing for recirculation of a cooling agent. The hermetic casing is connected with a plant recovering the waste heat. Also the duct of exhaust gases led out of the precipitation chamber to recover the waste heat is connected with a utilization assembly, for instance a fluidization apparatus, appropriated for heating up the mineral raw material before supplying it to treatment in the furnace.

From among numerous advantageous effects of the invention the following are worthy to be mentioned. Due to employing cyclone combustion chambers with a two-sided outlet of heating gases, entirely complete combustion of combustible gases is achieved.

A pilot execution of the furnace according to the invention has obtained heated gas streams with the capacity of an order of $40 \cdot 10^6$ kcal/m$^3$.h, resulting in very high capacities of cyclone reaction chambers, which for low-melting raw materials, that is melting at temperatures up to 1400° C., are expressed with a value of 1.2 t/m$^3$.h, and for those melting at temperatures of about 2000° C.—with the value of an order of 0.5 t/m$^3$.h.

The cyclone combustion chamber according to the invention, is able to liberate very large amounts of heat energy in a relatively small chamber volume, and provides the possibility to conduct the treatment process at temperatures of an order of 2500° C., with enrichment of the fuel mix with oxygen.

SUMMARY OF THE INVENTION

In the design according to the invention the advantages of the construction characteristic for the cyclone process are utilized. With respect to a set of features differing it in aspect of construction and accompanying method of conducting the treatment process, from known cyclone melting chambers and cyclone flame reactors, the design according to the invention constitutes a structure having the features of a universal cyclone furnace wherein very differentiated treated processes of combustion and sintering can be realized with no occurrence of liquid phase and no melting of mineral raw products having various designations.

A consequence of employing of a cyclone reaction chamber narrow in its lower portion, and a precipitation chamber, in case of melting the raw material, is an almost hundred-percent recovery of the fusion from the gas streams in the processing plant. Moreover, the precipitation chamber improves the homogenization of the fusion and the continuity of chemical reactions occurring therein.

Due to a high degree of separation of solid particles from the exhaust gases, the lasts can be successfully supplied to a plant recovering the waste heat.

Finally, it should be mentioned that the design according to the invention makes it possible to utilize coal as fuel in those processes, where the ash generated in course of combustion of the fuel is harmful to the product.

IN THE DRAWINGS

The invention will be now described in particular by means of an exemplary embodiment, with reference to the accompanying drawing, wherein.

DESCRIPTION OF THE INVENTION

Figure 1:
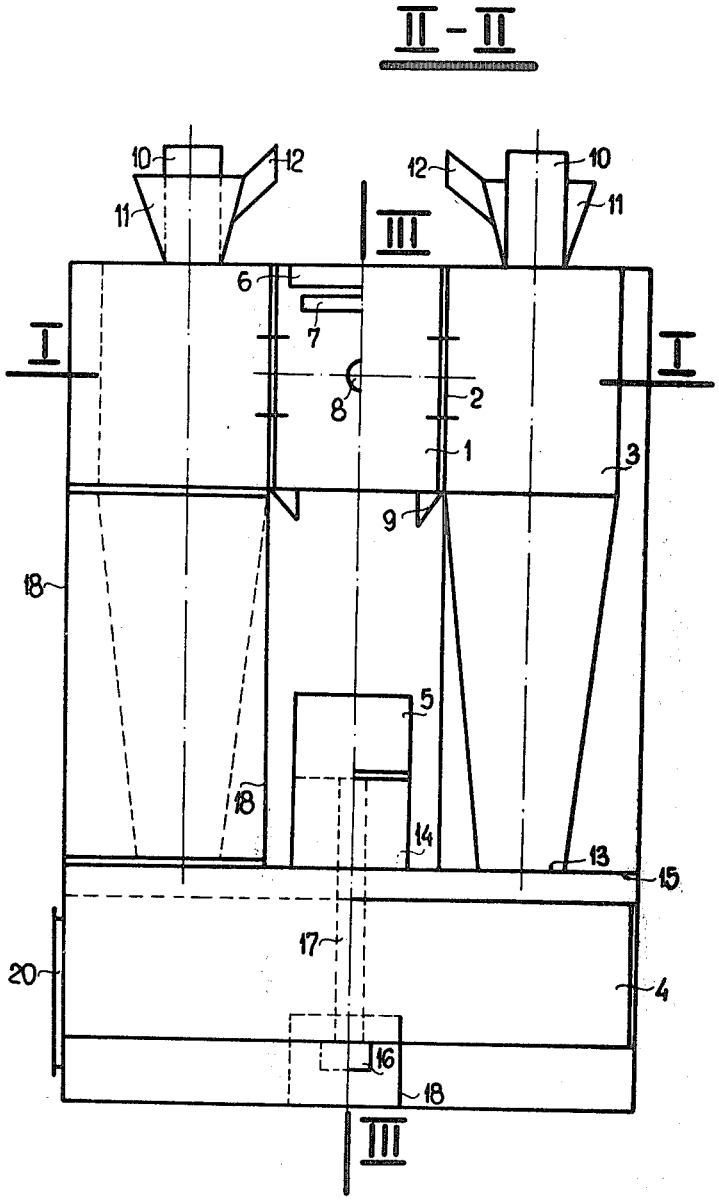
FIG. 1 is a partial view of the left half and the right part being symmetrical with the axial-sectional view taken along line II—II after FIG. 2.
Figure 2:
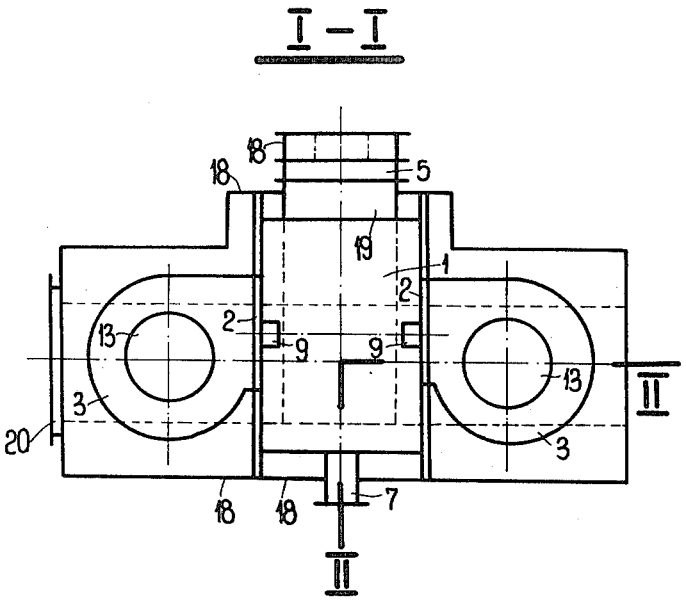
FIG. 2 is a cross-sectional view taken along line I—I of FIG. 1.

As shown in the drawings the cyclone furnace according to the invention is provided with a separate combustion chamber in form of an horizontal cylinder 1. Vertically, opposite, flat wall circular outlets 2 are arranged, whereof each leads to one or more cyclone raction chambers 3. The reaction chamber shown in circular horizontal cross-section, and has narrowed lower portion provided with circular discharge ports 13 leading to the precipitation chamber 4 having the form of a closed longitudinally extended tank. Apart from the outlets 13 in the roof 15 in upper part, the precipitation chamber is provided with a square outlet 14 of the exhaust gas duct 5. The outlet 14 is located in the middle of the entire length of the precipitation chamber 4, and the drain holes 13 are arranged symmetrically in relation to the outlet 14. In the vertical plane running through the axis of the outlet 14 is a square outlet of the discharge duct 16 arranged in the side wall of the precipitation chamber, close to the contact line with the bottom of the precipitation chamber 4. The furnace in its exemplary embodiment is equipped with the decompression duct 17 with circular cross-section, connecting the discharge duct 16 with the exhaust gase duct 5 in order to eliminate the effects of excessive dynamic pressure manifesting itself in pushing out a portion of the gases.

The cyclone combustion chamber 1 is equipped with horizontal oxygen carrier duct 6 arranged tangentially to the cylindrical wall of said chamber. Further, immediately below there is a slot-type burner 7, and still lower, on the level of the diameter of the combustion chamber, parallel to the burner 7 and the duct 6, is a displaceable burner 8 aimed at initiating the fuel burning process. The combustion chamber 1 is at its bottom provided with two stub pipes 9 contacting with the periphery of the flat walls of the combustion chamber, aimed at draining the molten ashes. The cyclone reaction chambers 3 have ducts 10 supplying the mineral raw material in the centre of the cover, in vertical axis of the chamber. Concentric compression chambers 11 are arranged at the outlets of the ducts 10, connected over stub pipes 12 with the compressed air source. The vertical axis of the cyclone combustion chamber 1 is displaced in relation to the vertical axes of the cyclone raction chambers 3, being equal to 1/6 of the diameter of the combustion chamber 1, and in a second embodiment (FIG. 3) ¼ of the diameter, to maintain an almost tangential flowing out of the gas streams from the combustion chamber 1 into the reaction chambers 3, and to set them in vortex motion. The furnace chambers 1, 3 and 4 are from inside lined with mineral refractory with the layer thickness of 25 mm, and from outsides having a hermetic casing 18 made of steel sheet. For inspecting the state of surfaces of the working elements of the furnace easily openable manholes 19 and 20 are provided.

ALTERNATE EMBODIMENT

Figure 3:
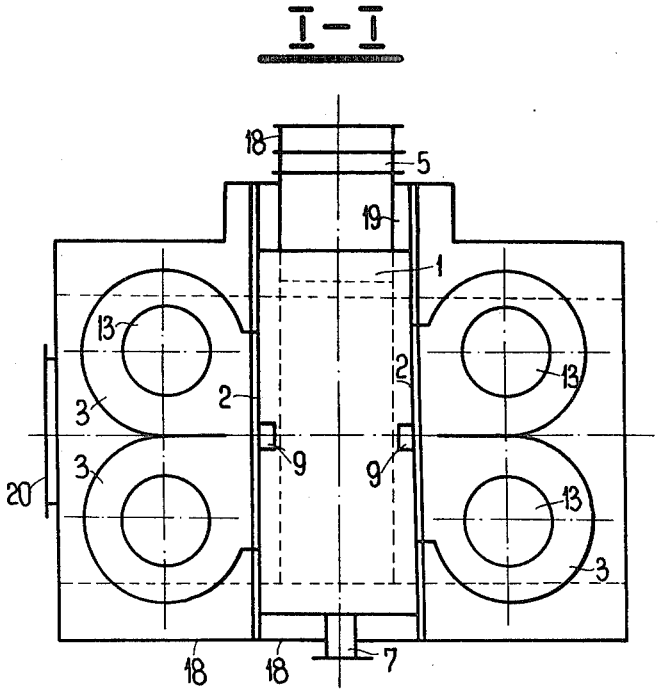
FIG. 3 is the cross-sectional view as in FIG. 2 of another variant of design according to the invention.
Figure 4:
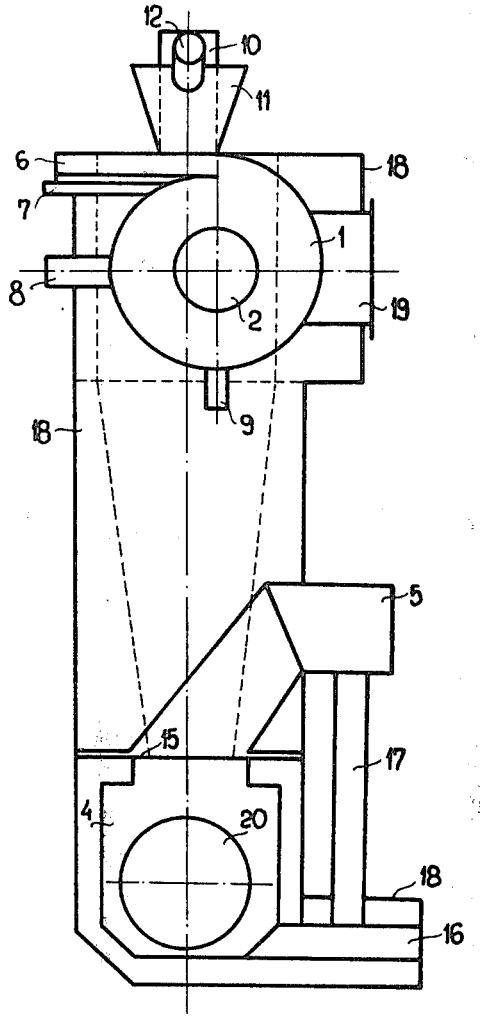
FIG. 4 is an axial sectional view of the first variant of the design, taken along line III—III of FIG. 1.

In a second embodiment of the exemplary embodiment of the furnace according to the invention, as shown in FIG. 3 in a cross-sectional view, the doubled number of reaction chambers 3 significantly contributes to an increase of the output of the furnace, without a considerable increase of the dimensions of the cyclone combustion chamber 1, and at utilizing the advantages shown by known cyclone melting chambers having small overall dimensions.

The furnace according to the invention specified with reference to the accompanying drawing does not excerpt all the possibilities of realization of the invention. Without changing the essence of the invention, it is for instance possible to make components of the structure or of assemblies of those elements in form of suitably profiled tubulated surfaces, whereby water flowing through tubes can be engaged into the circulation system of for instance a steam boiler. Also when employing a module system of the structure, carrying out of repairs and also replacement of worn furnace components is considerably facilitated.

The dividing lines of the structure modules are shown tentatively in the drawing with lines of double thickness.

What is claimed is:

1. A cyclone furnace for intensive treatment or combustion of dispergated mineral raw materials, comprising essentially, in a vertical arrangement, a cyclone reaction chamber; said chamber having means therewith for supplying heat energy into said chamber; discharge means disposed at a lower portion of said chamber for discharge of furnace products, a through precipitation chamber adopted to receive melted non-gaseous portion of treated material, said reaction chamber being provided with separate openings for draining off melt and an outlet for gases, wherein: said furnace being defined by a separate, essentially in horizontal arrangement, cyclone fuel combustion chamber with a two-sided outlet for products, enclosed with a cylindrical side wall to secure an essentially circular form of a cross-section of said chamber, and two non-cylindrical opposite front walls; means for supplying of energy-formation agents on the cylindrical side wall of said chamber by a tangential supplying of fuel and an oxygen carrier, and profiled outlets of combustion products from the cyclone chamber into at least two known and vertically disposed cyclone reaction chambers, said reaction chambers are disposed in opposite non-cylindrical front walls of the cyclone combustion chamber, both said cyclone reaction chambers being connected directly to the front walls of said cyclone combustion chamber and are provided with means for supplying said chambers with dispergated, mineral raw material, disposed axially on an upper cover; and in a narrowing portion from below there being outlets for gaseous and non-gaseous furnace products directly connected to said precipitation chamber, and said chamber connecting at least two reaction chambers whereby from the lowermost portion of its bottom, there being an outlet for the melted non-gaseous portion of the furnace products, and oppositely at the top the outlet of gaseous products there are provided, outlets centrically disposed in relation to the outlets of the process products from the reaction chambers.

2. A cyclone furnace as defined in claim 1, wherein; said means of tangentially supplying the energy-formative agents to the cyclone fuel combustion chamber with two-sided outlet of gases is disposed at the half of the length of cylindrical side wall of said chamber comprises, a duct for an oxygen carrier, said duct being of a slot type; a burner disposed immediately below said duct, and a protrudable initiating burner disposed in the vicinity of the diameter of said cyclone combustion chamber.

3. A cyclone furnace as defined in claim 1, wherein the cyclone combustion chamber with two-sided outlet of gases, is provided with outlets for discharging melted ash from the coal burned in said chamber, being arranged in close vicinity of both opposite non-cylindrical front walls.

4. A cyclone furnace as defined in claim 1, wherein: means for supplying each cyclone reaction chamber with dispergated mineral raw material disposed axially on the upper cover of said chamber and is provided with a concentrical compression chamber provided with connection to a compressed air source.

5. A cyclone furnace as defined in claim 1, wherein: discharge means for discharge of non-gaseous product of the furnace is connected with a pipe duct for draining gaseous products of the furnace products.

6. A cyclone furnace is defined in claim 1, wherein: the walls of the cyclone combustion chamber have two-sided gas outlets of the cyclone reaction chambers, and a precipitation chamber lined with a thin layer of mineral fire-resistant material and further being provided with a hermetic housing.

* * * * *